US010378261B2

(12) United States Patent
Hughes

(10) Patent No.: US 10,378,261 B2
(45) Date of Patent: Aug. 13, 2019

(54) DOOR CLOSER

(71) Applicant: Ian Hughes, Chesterfield (GB)

(72) Inventor: Ian Hughes, Chesterfield (GB)

( * ) Notice: Subject to any disclaimer, the term of this patent is extended or adjusted under 35 U.S.C. 154(b) by 324 days.

(21) Appl. No.: 15/287,382

(22) Filed: Oct. 6, 2016

(65) Prior Publication Data

US 2018/0100343 A1 Apr. 12, 2018

(51) Int. Cl.

| | |
|---|---|
| ***E05F 11/24*** | (2006.01) |
| ***E05F 15/60*** | (2015.01) |
| ***E05F 3/22*** | (2006.01) |
| ***E05F 1/00*** | (2006.01) |

(52) U.S. Cl.

CPC ..... *E05F 15/60* (2015.01); *E05F 1/002* (2013.01); *E05F 3/227* (2013.01)

(58) Field of Classification Search

CPC . E05F 15/60; E05F 15/63; E05F 15/75; E05F 15/00; E05F 1/002; E05F 3/227; E05F 3/102; E05F 1/00; E05F 3/221; E05F 3/222; E05F 2003/228; E05F 2015/631; E05F 16/63; E05Y 2900/132; E05Y 2400/856; E05Y 2900/531; E05B 47/0046; Y10T 292/28; Y10T 292/873

USPC ..... 49/32, 394, 33, 381; 16/52, 49; 292/262, 270; 290/1 R

See application file for complete search history.

(56) References Cited

U.S. PATENT DOCUMENTS

| | | | | |
|---|---|---|---|---|
| 3,415,562 A * | 12/1968 | Petersen | E05C 17/28 | 16/48.5 |
| 4,339,843 A * | 7/1982 | Burnett, Jr. | E05F 3/224 | 16/62 |
| 4,410,844 A * | 10/1983 | Plenzler | E05D 15/1081 | 318/280 |
| 4,658,545 A * | 4/1987 | Ingham | E05F 15/63 | 49/264 |
| 4,660,324 A * | 4/1987 | Nyenbrink | E05F 15/63 | 49/139 |

(Continued)

OTHER PUBLICATIONS

Search Report in Great Britain Application No. GB1505854.8; United Kingdom Intellectual Property Office.

(Continued)

*Primary Examiner* — Chi Q Nguyen

(74) *Attorney, Agent, or Firm* — Adler Pollock & Sheehan P.C.

(57) ABSTRACT

A door closer having a closer body 1 housing an electrical actuator 20 connected to one or more electrical connectors, such as plugs 24, each of which may be located in two or more different positions on the closer body to facilitate connection of the closer to an electrical circuit when the closer is mounted in different orientations, without providing a greater number of electrical connectors. The closer body may have a rotary shaft 7 connected to a door control arm 9, a first latch member 6 mounted relative to the closer body and a second latch member 29 mounted relative to the rotary shaft, the second latch member being arranged to engage with the first latch member to arrest rotation of the rotary shaft to latch the rotary shaft in a desired position. A mounting structure 8 connects the control arm and enables the angle between the control arm and the second latch member to be varied between 0 and at least 90 degrees.

19 Claims, 8 Drawing Sheets

(56) References Cited

U.S. PATENT DOCUMENTS

| | | | | |
|---|---|---|---|---|
| 4,878,265 | A * | 11/1989 | Nesbitt | E05B 47/0002 16/49 |
| 5,551,740 | A | 9/1996 | Lin et al. | |
| 5,806,246 | A * | 9/1998 | Azuma | B60J 5/062 49/360 |
| 7,971,316 | B2 * | 7/2011 | Copeland, II | E05F 3/12 16/79 |
| 8,527,101 | B2 * | 9/2013 | Burris | E05F 3/102 16/71 |
| 2007/0256362 | A1 * | 11/2007 | Hansen | E05B 47/0046 49/32 |
| 2008/0115543 | A1 * | 5/2008 | Lanigan | E05B 47/0046 70/57.1 |
| 2009/0093913 | A1 * | 4/2009 | Copeland, II | E05F 3/12 700/282 |
| 2010/0263284 | A1 | 10/2010 | Romer et al. | |
| 2011/0047876 | A1 * | 3/2011 | Houser | A47K 5/06 49/70 |
| 2011/0252597 | A1 | 10/2011 | Burris et al. | |

OTHER PUBLICATIONS

Search Report in Great Britain Application No. GB1406044.6; United Kingdom Intellectual Property Office.

* cited by examiner

DOOR CLOSER

TECHNICAL FIELD OF THE INVENTION

The present invention relates to a door closer.

BACKGROUND TO THE INVENTION

Door closers are mounted to hinged doors to urge them towards a closed position. An existing type of door closer comprises an elongate rectangular base plate intended to be fixed towards the top of a door, with a long side parallel to the top of the door. The base plate supports a spring loaded actuator and damper arrangement with a rotary shaft protruding from each end and extending perpendicular to the long sides of the base plate. The shaft is biased towards a stop, and may be rotated against the spring bias away from the stop.

In use, the base plate is affixed to a door. One end of an elongate arm is rotationally connected to the rotary shaft extending from the top of the actuator. The opposite end of the elongate arm is pivotally connected to the end of a second elongate arm, and the opposite end of the second elongate arm is pivotally mounted to the door frame by a bracket. The closer is mounted so that when the door is in a closed position the rotary shaft is held away from its stop so that the resilient bias of the actuator urges the door towards its closed position. As the door is opened, the arms cause the rotary shaft to be further rotated against the resilient bias, so that when the door is released, the actuator effects a controlled closing of the door as the spring urges the rotary shaft back towards its stop, overcoming friction of the damper.

If the door is hung from its left hand side, when facing the side of the door to which the closer is mounted, the closer is mounted to the door with one end of the rotary shaft uppermost. If the door is hung from its right hand side, when facing the side of the door to which the closer is mounted, the closer is mounted to the door with the opposite end of the rotary shaft uppermost so that the actuator urges the shaft to rotate in a direction which causes the door to close.

Therefore, when the closer is mounted to the push side of the door the same end of the closer will be positioned towards the hinged side of the door whether the door is hinged to its left or right side. When the closer is mounted to the pull side of the door the opposite end of the closer will be positioned towards the hinged side of the door, again irrespective as to whether the door it hinged to its left or right side. So the closer is mounted in one of four different orientations depending on which side of a door it is mounted on, and from which side the door is hung.

It is known for door closers to include a latch arrangement which engages when a door is opened to prevent the door closing under the action of the closer. The latch can be released by operation of an electrical solenoid to allow the door to close. Typically, an electrical switch is provided to enable a user to operate the solenoid and allow the door to close. The solenoid may also be operated automatically in the event that a fire alarm system is triggered.

The solenoid is electrically connected to a suitable electrical circuit by an electrical cable which runs downwardly from the underside of the closer adjacent the end of the closer towards the hinged side of the door and follows a U-shaped path to connect to a connection box disposed on the door frame adjacent the hinged side of the door. This enables a short length of cable to be employed as well as limiting stress on the cable through movement of the door.

To accommodate this, existing door closers of this type include four electrical connections, one at each opposite end of each long side of the base plate. This increases the cost and complexity of manufacture. Or, different versions of a door closer are provided depending on the intended installation, which gives rise to inventory control issues in maintaining and selecting from a stock of different types of closer.

The latch arrangement comprises a latch member which may protrude from either of the long sides of the closer, adjacent the rotary shaft. A second latch member is provided on a plate secured to the rotary shaft, for rotation with the shaft, and the two latch members engage to prevent the shaft rotating back when a door has been fully opened. The elongate arm is mounted to the rotary shaft via the plate, and its position may be adjusted relative to the plate in order to determine the angle of opening of the door at which the latch engages to hold the door open. The angle of the elongate arm relative to the plate, and thus the second latch member, varies not only in dependence on the angle at which the door is to be latched open, but also on whether the closer is mounted on the push or pull side of the door.

To accommodate this variation one current door closer is supplied with two different plates and the appropriate plate must be selected according to the manner of its installation. Another current closer is provided with a reversible plate, and the plate must be oriented on the rotary shaft according to the manner of its installation. In both cases this adds complexity to installation. Providing two different types of plates is wasteful as only one is used, or adds complexity to inventory control and supply of the plate if only a selected single plate is supplied with a closer. The reversible plates are effectively a combination of both types of existing plate, and whilst providing a single plate simplifies supply of plates it is still necessary to orient it correctly and additional material is used in producing a double sided plate as opposed to a single plate suited to a particular installation.

Embodiments of the present invention have been made in consideration of these problems.

SUMMARY OF THE INVENTION

According to a first aspect of the invention there is provided a door closer comprising a closer body housing an electrical actuator which is electrically connected to an electrical connector which enables the actuator to be connected to a control circuit, wherein the electrical connector may be located in two or more different positions on the closer body in order to facilitate connection of the closer to an electrical circuit when the closer is mounted in different orientations.

By providing an electrical connector which can be located in two or more different positions it is possible to allow for mounting of the door closer in different configurations but provide fewer (or just one) electrical connector compared with the four required by existing closers.

The electrical connector may be arranged to connect to a complimentary connector and could be an electrical plug or socket.

The electrical connector may be movably, such as pivotally, mounted to the closer body enabling the electrical connector to be moved relative to the closer body between the two or more different positions. The electrical connector may be pivoted relative to the closer body from a first position where the connector is accessible from a first face of the closer body and a second position where it is accessible from a second face of the body. The first and second faces of the closer body may be generally parallel and located on opposite sides respectively of the closer body.

In one arrangement there are two or more electrical connectors, each connected to the electrical actuator and each electrical connector may be located in two or more different positions on the closer body.

The electrical actuator, which may be a solenoid, may be operable to release a latch to allow the door closer to close a door in relation to which it is installed.

The closer body may be elongate, and may be substantially cuboidal, and have two long sides connected by two short ends, and be provided with a respective electrical connector at each end. Each electrical connector may be movable between a first position where it is accessible from one long side of the body and a second position where it is accessible from the opposite long side of the body.

According to a second aspect of the present invention there is provided a door closer comprising closer body having a rotary shaft connected to a door control arm, a first latch member mounted relative to the closer body and a second latch member mounted relative to the rotary shaft, the second latch member being arranged to engage with the first latch member to arrest rotation of the rotary shaft to enable the rotary shaft to be latched in a desired position, wherein the door control arm is connected to the rotary shaft by a mounting structure which enables the control arm to be mounted to the shaft so that the angle between the control arm and the second latch member can be varied between 0 and at least 90 degrees.

This enables a single mounting structure to be used to enable the closer to be deployed on the push or pull sides of left or right hinged doors.

The mounting structure may enable the control arm to be mounted to the shaft so that the angle between the control arm and the second latch member can be varied between 0 and at least 80 degrees.

The angle may be varied between the claimed range either side of the second latch member.

The second latch member may be mounted to or formed on the mounting structure and may take the form of a tab. The first latch member may take the form of a spring loaded catch and may be arranged to be released by an electrical actuator.

The mounting structure may be a mounting plate. It may comprise a structure for mounting the plate to the rotary shaft so that the plate rotates with the shaft about a centre of rotation, such as a non-circular (for example square) aperture. The mounting plate may further comprise an arcuate slot having an at least part circular curvature centred about the axis of rotation. The arcuate slot may extend between the second latch member and the centre of rotation. The arcuate slot may be substantially symmetrical about a line extending from the centre of rotation to the second latch member. The arcuate slot may extend through an angle of at least 150 or 160 degrees and it may extend through an angle of less than 180 or 190 degrees.

Door closers according to the second aspect of the invention may comprise any or all of the features of door closers according to the first aspect of the invention, as desired or as appropriate.

DETAILED DESCRIPTION OF THE INVENTION

In order that the invention may be more clearly understood an embodiment thereof will now be described, by way of example only, with reference to the accompanying drawings, of which:

Figure 1:
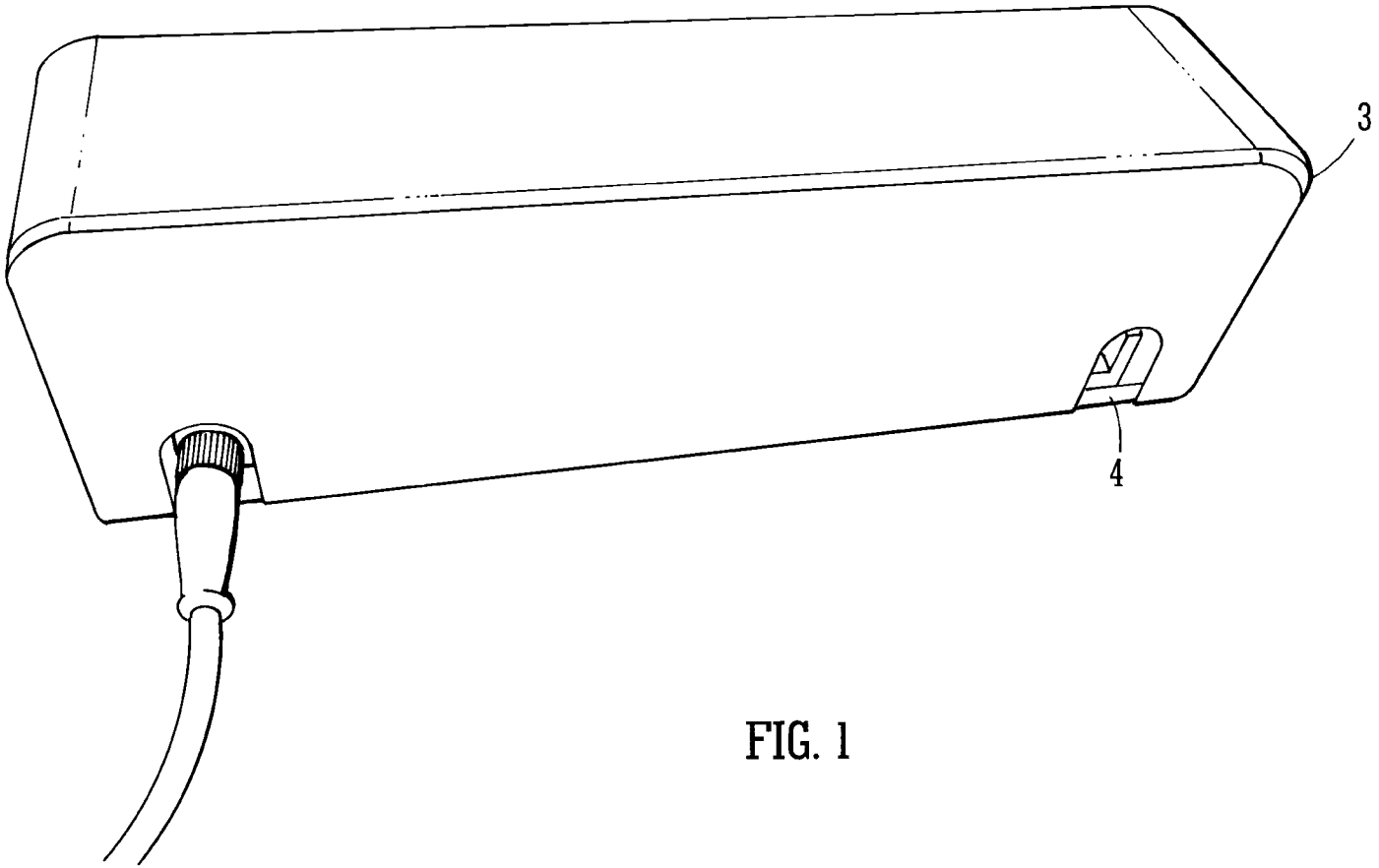
FIG. 1 is a perspective view of a door closer from below.
Figure 2:
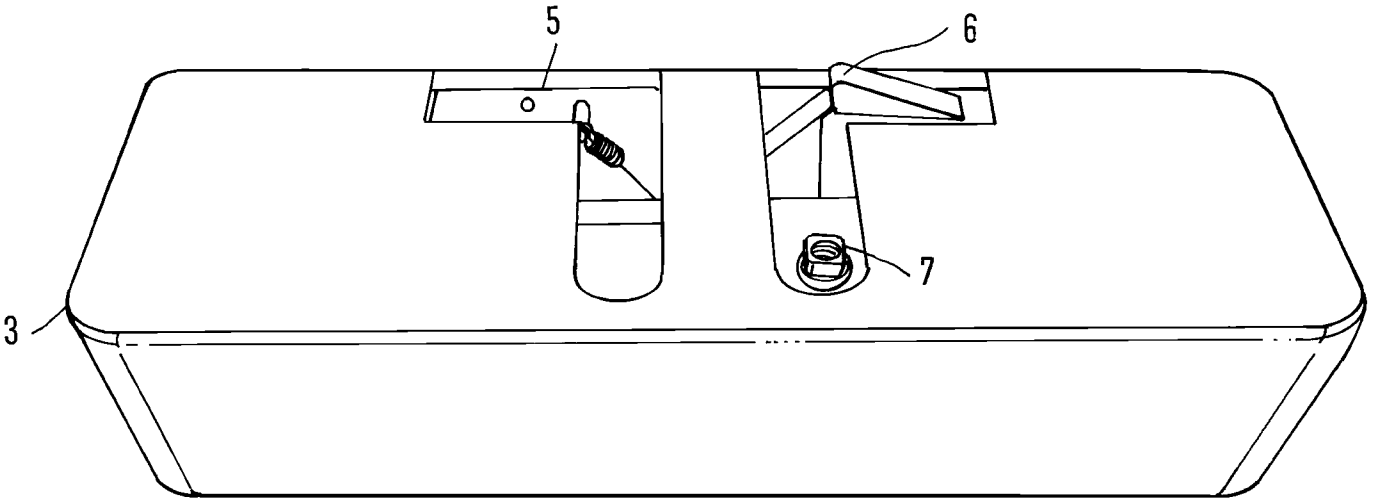
FIG. 2 is a perspective view of the door closer of FIG. 1 from above without a door control arm or mounting plate fitted.
Figure 3:
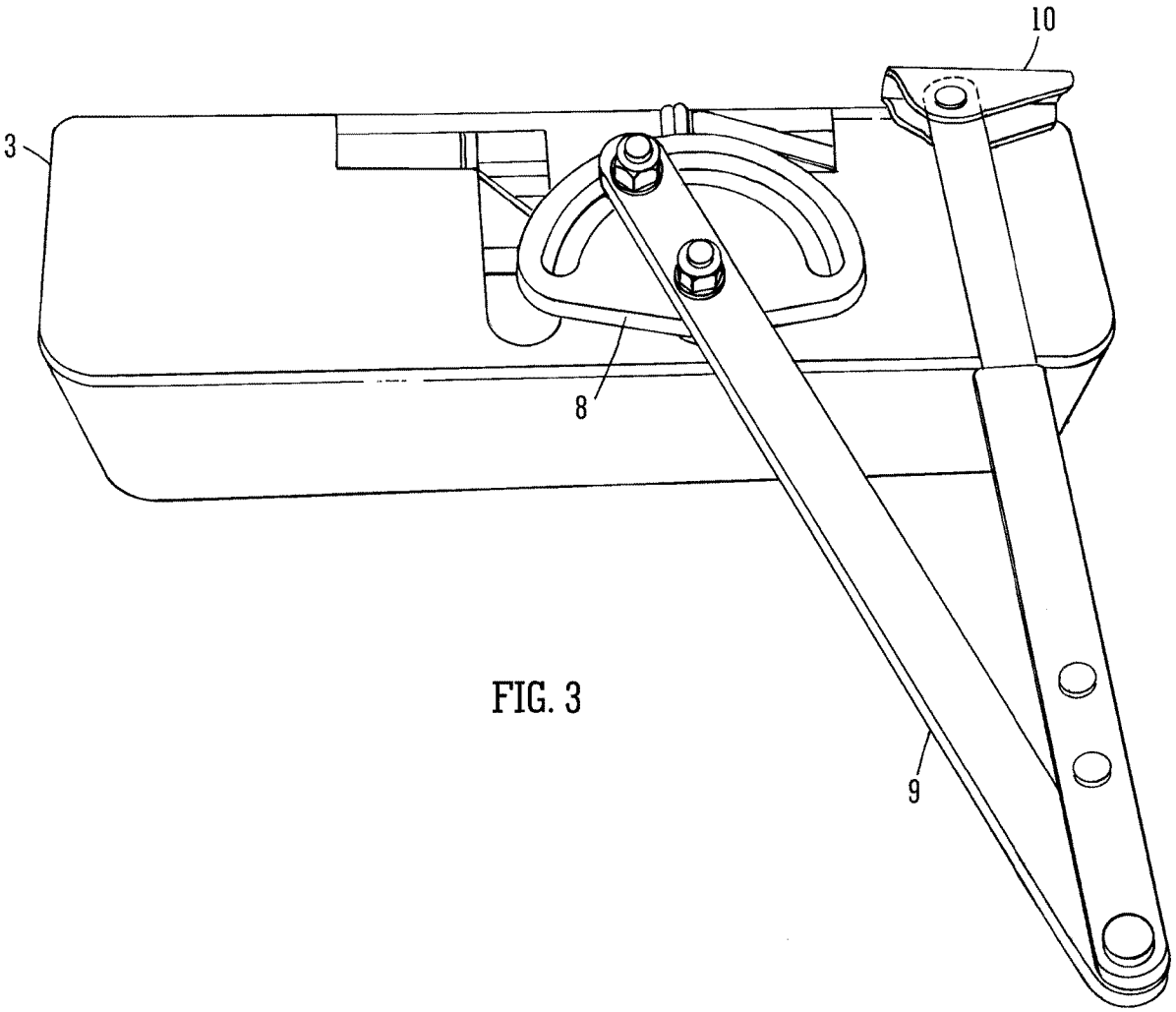
Figure 4:
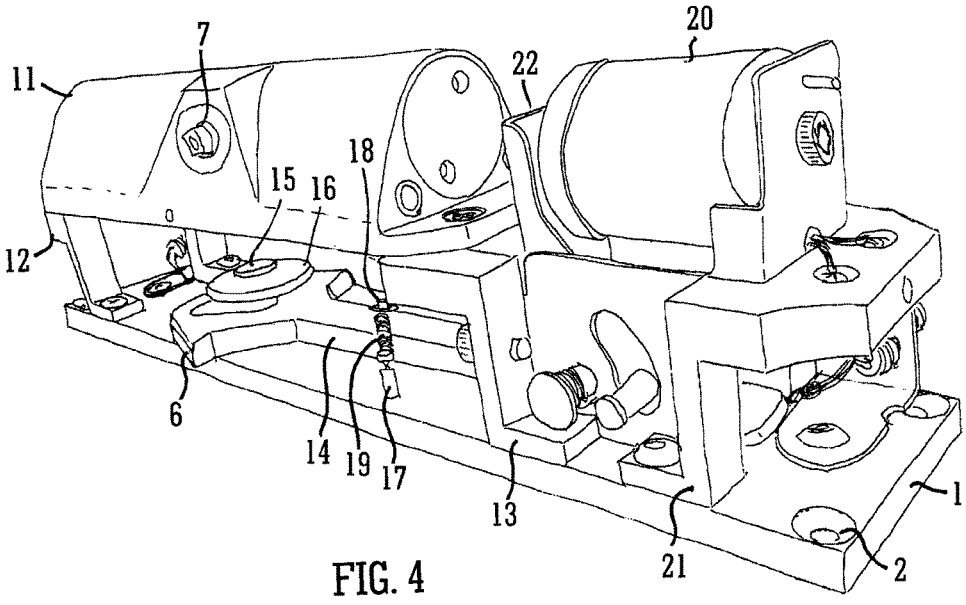
Figure 5:
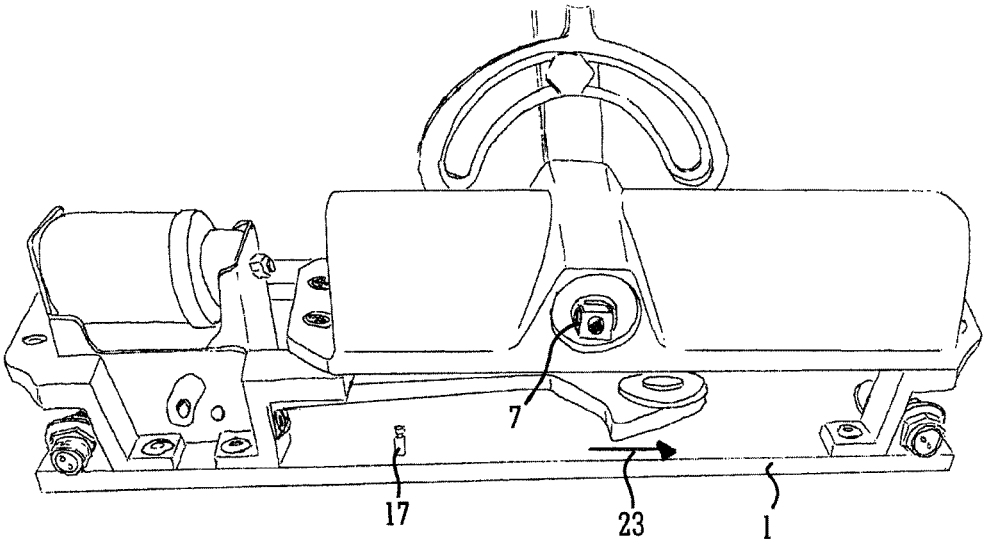
Figure 6:
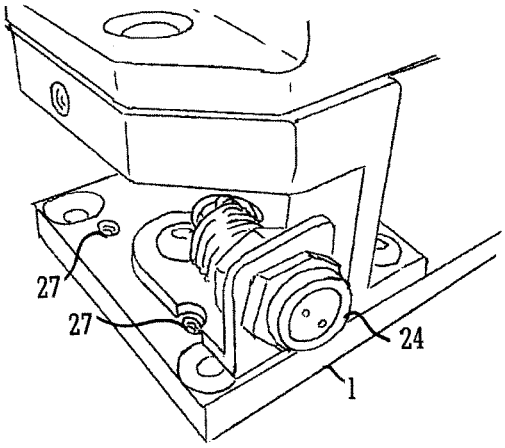
Figure 7:
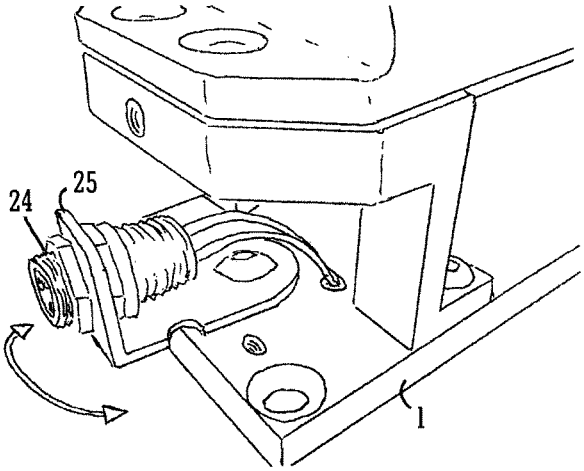
Figure 8:
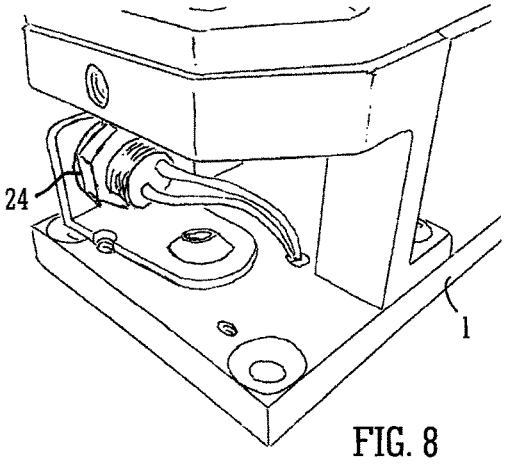
Figure 9:
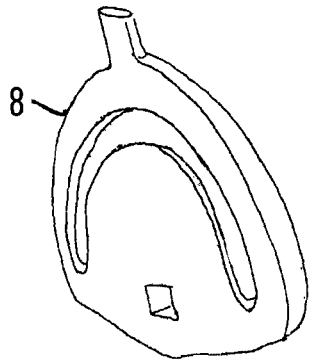
Figure 10:
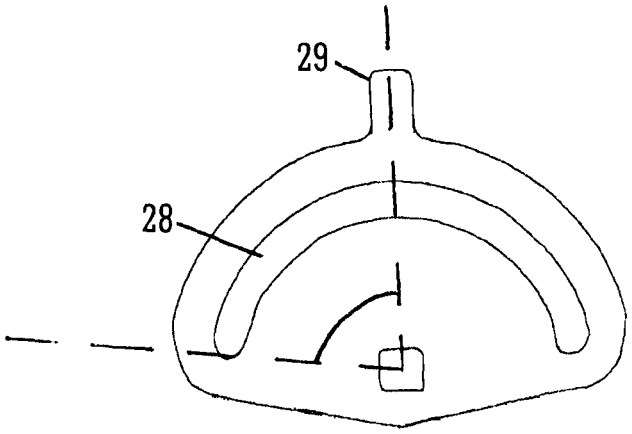
Figure 11:
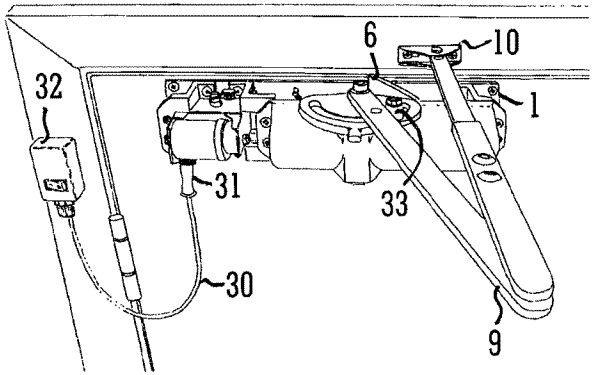
Figure 12:
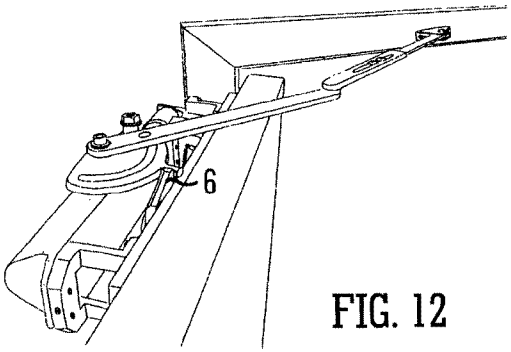
Figure 13:
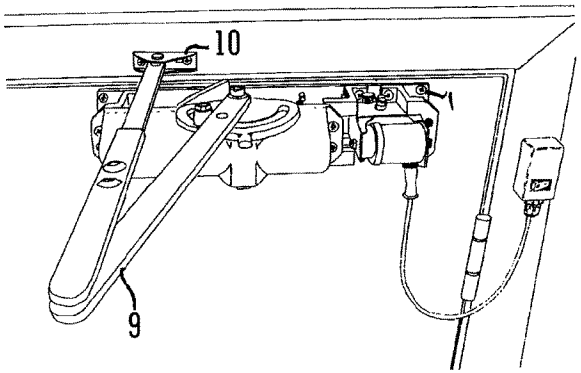
Figure 14:
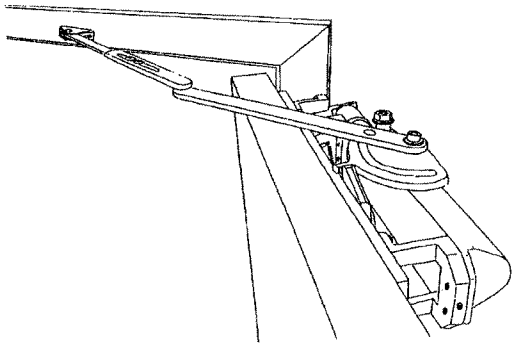
Figure 15:
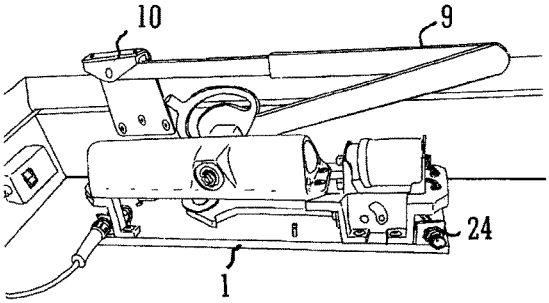
Figure 16:
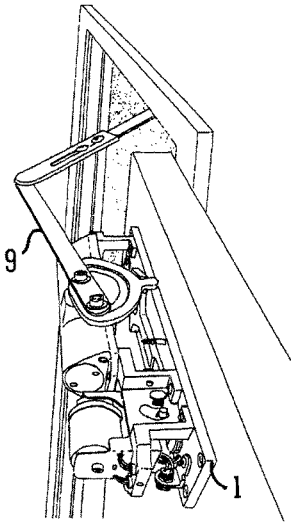

FIG. 3 corresponds to FIG. 2 with a door control arm and mounting plate fitted;

FIG. 4 is a perspective view of the door closer of FIG. 1, with its cover removed, from one side and without a door control arm or mounting plate fitted;

FIG. 5 is a perspective view of the door closer of FIG. 1, with cover removed, from the opposite side to FIG. 4 showing a door control arm and mounting plate fitted;

FIGS. 6-8 are perspective views of one end of the door closer of FIG. 1 with cover removed, each Figure showing an electrical connector in a different position;

FIG. 9 is a perspective view of a door control arm mounting plate;

FIG. 10 is a plan view of the plate of FIG. 9;

FIG. 11 is a perspective view of the door closer of FIG. 1 fitted to the pull side of a left-hand hinged door with the door in a closed position;

FIG. 12 shows the arrangement of FIG. 11 with the door in an open and latched position;

FIGS. 13 & 14 correspond to FIGS. 11 and 12, but for a right-hand hinged door;

FIG. 15 is a perspective view from below of the closer of FIG. 1 fitted to the push side of a left-hand hinged door with the door in a closed position;

FIG. 16 shows the door of FIG. 15 in an open and latched position; and

Figure 17:
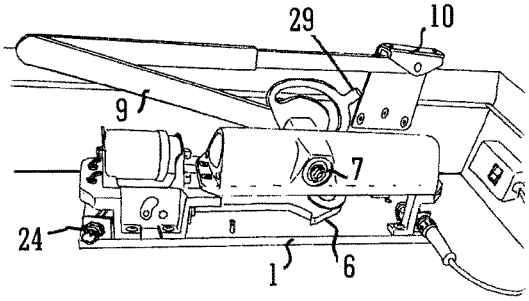
Figure 18:
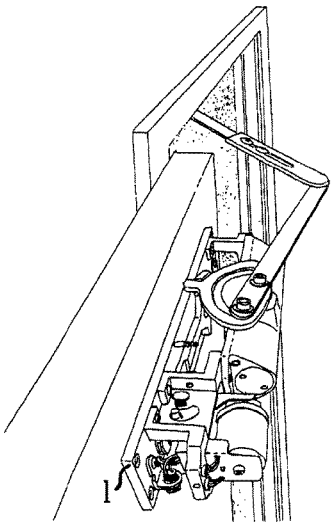

FIGS. 17 & 18 correspond to FIGS. 15 and 16, but for a right-hand hinged door.

In what follows the terms the terms top, bottom, side and similar terms refer to the apparatus in the orientation in which it is illustrated in the drawings but should not be taken to be otherwise limiting.

Referring to FIGS. 1 to 10 a door closer comprises an elongate, substantially rectangular mounting plate 1 provided with a countersunk hole 2 towards each corner to enable it to be mounted to a door or a door frame or other structure adjacent to a door using screws or other suitable fasteners. Components of the door closer (described further below) are mounted to the base plate 1 and a cover 3 is fitted over the base plate 1 covering the components mounted on the base plate. The cover 3 takes the form of an elongate cuboidal box with one open side. The cover 3 is configured so that the open side fits closely around the base plate 1. Two parallel sided slots 4 with curved ends are formed towards opposite ends respectively in the free edge of the face of the cover which forms the underside in use, as best seen in FIG. 1. These permit access to electrical connectors, discussed further below.

Two, larger, capital L shaped cut-outs 5 are formed in the side of the cover which forms its top face in use, as best seen in FIGS. 2 and 3. These allow a latch member 6 to extend through the cover and a rotary shaft 7 to be accessed through the cover. In use a mounting plate 8 is mounted to the rotary shaft and a door control arm 9 is mounted to the rotary shaft 7 and mounting plate 8. The door control arm comprises a first elongate arm pivotally connected at one end to a second elongate arm. The second elongate arm is formed from two slidably or telescopically connected components, to enable its length to be adjusted. The free end of the second arm is pivotally connected to a mounting bracket 10 which in use is fixed to a door or door frame or other surface adjacent to a door. Towards one end of the base plate 1 a spring and damper actuator assembly 11 is mounted to the base plate by way of spacers 12, one at each end of the actuator assembly. The actuator supports the rotary shaft 7. The shaft has a square (or other non-circular) cross section and extends out of opposite faces of the actuator 11 along a direction substantially perpendicular to the long sides of the base plate 1 and at a positions slightly displaced from the centre of the long sides so that when the cover 3 is fitted to the base plate 1 it is an accessible through one of the two L-shaped slots 5 in the cover 3. The actuator is operative to resiliently bias the rotary shaft against a stop. Thus, the rotary shaft 7 may be rotated against the resilient bias of the actuator in one direction and when released will be rotated back in the opposite direction. Such actuators are common to known door closers and will therefore not be described in further detail.

An elongate latch body 14 is slidably mounted to the base plate 1 between the base plate 1 and actuator 11. Under the actuator 11 the latch body terminates in a head having two opposed tapering sides which taper towards its free end. These tapering sides form two latch members 6, one on each side the latch body. A triangular aperture extends through the head of the latch body 14 and a fastening pin 15 extends through a washer 16 and the triangular aperture in the head 6 of the latch member into the base plate 1 to slidably retain the latch body 14 relative to the base plate 1. A respective pin 17 is mounted towards the long edge of the base plate 1 at each opposite side of the plate. A pin 18 is also provided on the latch body 14, about half way along its length and at a position between the head of the latch member and the position of the pins 17 on the base plate 1. A helical spring 19, or other resilient member, is fastened to one of the pins 17 on the base plate at one end and to the pin 18 on the latch body at its opposite end. The spring 19 acts to bias the latch body towards one lateral long edge of the base plate and longitudinally towards the opposite end of the base plate 1 to that at which the actuator 11 is mounted. Movement of the latch body in the direction in which it is biased is limited by the pin 15 coming into contact with the inside edge of the triangular aperture formed through the latch member 14.

Towards the opposite end of the base plate 1 to the actuator 11 a solenoid 20 (or other suitable actuator) is mounted on a spacer 21, similar to those on which the actuator 11 is mounted. The solenoid is operatively connected to a pivot plate 22 which in turn is operatively connected to the opposite end of the latch body 14 to its head. The solenoid 20 is arranged, when energised, to urge the latch body 14 in the direction of its head; that is to say, in the direction of the arrow 23 drawn on FIG. 5. Owing to the shape of the aperture through which pin 15 extends, this causes the latch body 14 to move against the action of spring 19, away from the long edge of the base plate into a central position on the base plate 1 at which neither latch member 6 protrudes beyond a long edge of the base plate 1. The construction and operation of this latch arrangement is common to known door closers and therefore is not described in further detail.

The solenoid 20 is electrically connected, in parallel, to two electrical connectors 24 by electrical wires. In the illustrated example these connectors are electrical plugs comprising pins which are arranged to be received into a complementary electrical socket. The connectors could, however, be sockets or any other form of electrical connector which enables an electrical connection to be established with a complementary connector. Or, they could be a connector arranged to connect directly to electrical wires or other electrical conductors.

Each connector 24 is mounted in an aperture through one arm of an L-shaped bracket 25. The other arm is pivotally mounted to the base plate 1 by a fastener so that it can pivot about a point substantially mid-way between opposite long sides of the base plate 1 enabling the connector to face one, or the opposite, long side of the base plate 1. This enables the position of each connector to be adjusted so that it faces one or the other long side of the base plate 1 as desired. A pair of bores 27 is provided at each end of the base plate 1 for receiving a pin or other fastener in order to lock the L-shaped bracket 25 in a position where the connector 24 faces one, or the opposite, long side of the base plate 1. The electrical connectors 24 enable an electrical connection to be made between the solenoid 20 and a control circuit.

The door control arm mounting plate 8 is formed from a flat plate with a square aperture extending therethrough sized to fit snugly over the rotary shaft 7 of the actuator 11 so that the mounting plate 8 and rotary shaft 7 are rotationally fixed relative to each other. A part circular arcuate slot 28 is formed in the mounting plate 8, with its centre of curvature centred about the centre of the square aperture. The edge of the mounting plate 8 closest to the convex side of the arcuate slot 28 is parallel to the arcuate slot except that a rectangular tab forming a second latch member 29 protrudes from the otherwise arcuate surface of the plate at a position substantially midway between the ends of the arcuate slot. The arcuate slot extends through an angle of approximately 75 degrees between each end and its midpoint, coinciding with the midpoint of the second latch member 29.

The mounting plate 8 is sized so that, as it rotates with the rotary shaft 7 against the action of the actuator 11, the second latch member 29 approaches a tapered side of the latch member 6. So, when the latch member spring 19 is arranged to urge the latch body 14 to the same side of the device to which the mounting plate is fitted the latch member 6 allows the second latch member 29 to pass as the mounting plate and rotary shaft 7 are rotated against the action of the actuator, but not to return in the opposite direction, under the action of the actuator, unless the solenoid 20 is operated to draw the latch 6 member into the closer, allowing the second latch member 29 to pass. This enables a door to be latched open, and then allowed to close by operating the solenoid 20.

In use, the closer may be mounted in one of four different configurations to allow it to be mounted to the push or pull side of left or right hinged doors (as viewed from the side of the door to which the closer is fitted). These four configurations are illustrated in FIGS. 11 to 18.

In all configurations the closer is mounted towards the top edge of the door so that the upper edge of the base plate 1 is parallel (and may be flush with) the top edge of the door, and towards the hinged side of the door, typically between the midpoint and hinged side of the door. The closer is oriented so that the upper end of the rotary shaft 7 is biased to rotate by the actuator 11 in a direction which will cause the door to close. For example, when the closer is mounted to the pull side of a left hand hinged door (as shown in FIGS. 11 and 12) it is oriented so that the actuator urges rotary shaft 7 (when viewed from above) in an anticlockwise direction. When the closer is mounted to the pull side of a right hand hinged door (as shown in FIGS. 13 and 14) it is mounted the opposite way up, so that the opposite end of the rotary shaft is uppermost and the actuator urges the shaft in a clockwise direction as viewed from above.

When it is decided which way the closer is to be oriented, the latch spring 19 is positioned between the latch pin 18 and the pin 19 on the base plate 1 which will be uppermost when the closer is mounted to the door so that the spring urges the latch body 14 upwards so that the upper latch member 6 extends beyond the upper edge of the base plate 1.

Then, the electrical connector 24 at the end of the closer which will be closest to the hinge side of the door is positioned so that it faces downwards by, if necessary, pivoting the L-shaped plate and inserting a locking pin into the appropriate bore 27.

The closer is then mounted to the door by passing fasteners such as screws through the apertures in the base plate and into the door.

A flexible electrical cable 30, with an appropriate connector 31 fitted to its end, is then connected to connector 24 at the end of the closer adjacent the hinged side of the door. The other end of the cable is connected to the underside of a connector box 32 mounted to the door frame so that the cable runs in a U-shaped path between the closer and the junction box. The connector box 32 electrically connects the cable 30, and thus the solenoid 20 of the closer, to a door control circuit and may include a switch 33 which enables the closer to be isolated from the door control circuit.

The door control arm 9 must also be fitted to the closer, and fasted to the door frame, or other structure, above the door.

The configuration of the door control arm depends upon whether the closer is fitted to the push or pull side of the door, and whether or not it is intended that the door can be latched open or not.

The first end of the door control arm, which fastens to the closer, is provided with two apertures, a first aperture at the free end of the arm and a second aperture spaced away from the first aperture so that the centres of the two apertures are spaced by about the same distance as that between the centre of the rotary shaft 7 and the radial centre of the arcuate slot in the mounting plate 8.

When the closer is mounted to the pull side of a door, as shown in FIGS. 11 to 14, the first aperture in the door control arm is positioned over the rotary shaft and a bolt or other fastener passed through the aperture into a bore in the rotary shaft 7. The bolt serves to retain the door control arm on the mounting plate 8 but not to rotationally fix the arm relative to the mounting plate or rotary shaft.

A second bolt or other fastener is then passed through the arcuate slot 28 in the mounting plate 8 in order to set the angle, or a limit on the angle, between the door control arm 9 and the second latch member 29 of the mounting plate such that at a desired angular opening of the door the second latch member 29 passes the latch member 6 of the closer.

In the former case (not shown in FIGS. 11 to 14) the bolt is passed through the second aperture in the door control arm 9 and the arcuate slot 28 and a nut fastened to the bolt to clamp the two together and fix the door control 9 arm rotationally to the mounting plate 8 and thus the rotary shaft 7 of the closer. Then, as the door is opened, the door control arm 9 will rotate the rotary shaft 7, via the mounting plate 8, against the resilient bias of the actuator 11. When the door has been opened through a predetermined angle the second latch member 29 on the mounting plate passes the latch 6, temporarily urging the latch 6 downwards against the action of spring 19. As the second latch member passes the latch member 6, the spring 19 returns the latch member to its original position. This prevents the second latch member 29 passing back past the latch member 6, preventing movement of the door control arm 9 and holding the door open at the predetermined angle. When it is desired to close the door the solenoid 20 is temporarily operated causing the latch member 6 to temporarily lower and allowing the second latch member 29 to move under the action of the actuator and close the door.

In the latter case the bolt is passed through a collar 33, through the arcuate slot 28 and into a nut enabling the collar to be clamped to the mounting plate 8. The collar 33 forms a stop which prevents movement of the door control arm 9 relative to the mounting plate. This arrangement is illustrated in FIGS. 11 to 14. In this arrangement, when the door is closed the actuator 11 biases the rotary shaft 7 so that, via the mounting plate 8, the collar 33 is urged into contact with the door control arm 9, keeping the door closed. As the door is opened the door control arm 9 rotates the rotary shaft 7 via the collar 33 against the resilient bias of the actuator 11. When the door is opened through a predetermined angle the second latch member 29 moves past the latch member 6, which prevents the second latch member, and therefore the mounting plate 8 and rotary shaft 7, moving back under the action of the actuator 11. However, since the door control arm 9 is not rotationally fixed to the mounting plate or rotary shaft the door can swing freely between the closed position and the predetermined angle. When the solenoid is activated this will release the latch 6 allowing the actuator to rotate the latch plate 8 whereupon the door will be moved to the closed position from any position intermediate the closed position and the predetermined angle.

When the closer is mounted to the push side of a door the configuration shown in FIGS. 15 to 18 is adopted. In this configuration the second aperture in the door control arm 9 is aligned with the rotary shaft 7 and the first hole lies over the arcuate slot 28 in the mounting plate 6 and is either clamped to the mounting plate by a nut and bolt or other fastener (as shown in FIGS. 15 to 18) or is arranged to bear against a stop formed by a collar bolted to the mounting plate.

In each case the opposite end of the door control arm is pivotally connected to a bracket which is fastened to the door frame or other structure adjacent the door.

When the closer has been mounted the cover 3 can be placed over the closer, one of the slots in the lower face accommodating the electrical connector 31 and one of the L-shaped slots in the upper face accommodating the rotary shaft 7 and latch 6.

The door closer may be used in all four installation configurations and in the illustrated embodiment is able to latch a door open at an angle of up to 180 degrees when the closer is mounted to the push side of the door and 135 degrees when it is mounted to the pull side of the door.

Provision of the movably mounted electrical connectors, and the mounting plate which allows for an angle between the door control arm and second latch to be set at up to over 70 degrees either side of the second latch enables the closer to be fitted in all four of the illustrated configurations without the need to provide additional components or to require reorientation of components.

The above embodiment is described by way of example only. Many variations are possible without departing from the scope of the invention as defined in the appended claims.

The invention claimed is:

1. A door closer comprising a closer body; the closer body configured to be mounted to a door in different orientations; the closer body housing an electrical actuator which is electrically connected to an electrical connector that enables the actuator to be connected to a control circuit, wherein the electrical connector is locatable in two or more different positions on the closer body in order to facilitate connection of the closer to an electrical circuit when the closer body is mounted in different orientations; and wherein the closer body is elongate having two long sides connected by two short ends, and is provided with at least one electrical connector being movable between a first position where the connector is accessible from one long side of the body and a second position wherein the connector is accessible from the opposite long side of the body.

2. A door closer as claimed in claim 1 wherein the electrical connector is arranged to connect to a complementary connector.

3. A door closer as claimed in claim 1 wherein the electrical connector is an electrical plug or socket.

4. A door closer as claimed in claim 1 wherein the electrical connector is movably mounted to the closer body enabling the electrical connector to be moved relative to the closer body between the two or more different positions.

5. A door closer as claimed in claim 4 wherein the electrical connector is pivotally mounted to the closer body.

6. A door closer as claimed in claim 4, wherein the electrical connector is able to be moved relative to the closer body from a first position where the connector is accessible from a first face of the closer body and a second position where the connector is accessible from a second face of the body.

7. A door closer as claimed in claim 6 wherein the first and second faces of the closer body are generally parallel and located on opposite sides respectively of the closer body.

8. A door closer as claimed in claim 1, further comprising two or more electrical connectors, each connected to the electrical actuator and wherein each electrical connector is locatable in two or more different positions on the closer body.

9. A door closer as claimed in claim 1, wherein the electrical actuator is operable to release a latch to allow the door closer to close a door in relation to which the door closer is installed.

10. A door closer comprising a closer body; the closer body configured to be mounted to a door in different orientations; the closer body housing an electrical actuator which is electrically connected to an electrical connector that enables the actuator to be connected to a control circuit, wherein the electrical connector is locatable in two or more different positions on the closer body in order to facilitate connection of the closer to an electrical circuit when the closer body is mounted in different orientations, wherein the closer body has a rotary shaft connected to a door control arm, a first latch member mounted relative to the closer body and a second latch member mounted relative to the rotary shaft, the second latch member being arranged to engage with the first latch member to arrest rotation of the rotary shaft to enable the rotary shaft to be latched in a desired position, and wherein the control arm is connected to the rotary shaft by a mounting structure which enables the control arm to be mounted to the shaft so that the angle between the control arm and the second latch member can be varied between 0 and at least 90 degrees.

11. A door closer comprising a closer body; said closer body having a rotary shaft connected to a door control arm, a first latch member mounted relative to the closer body and a second latch member mounted relative to the rotary shaft, the second latch member being arranged to engage with the first latch member to arrest rotation of the rotary shaft to enable the rotary shaft to be latched in a desired position, wherein the control arm is connected to the rotary shaft by a mounting structure which enables the control arm to be mounted to the shaft so that the angle between the control arm and the second latch member can be varied between 0 and at least 90 degrees.

12. A door closer as claimed in claim 11 wherein the mounting structure enables the control arm to be mounted to the shaft so that the angle between the control arm and the second latch member can be varied between 0 and at least 180 degrees.

13. A door closer as claimed in claim 11 wherein the angle can be varied between the claimed range either side of the second latch member.

14. A door closer as claimed in claim 11 wherein the second latch member is mounted to or formed on the mounting structure.

15. A door closer as claimed in claim 11 wherein the mounting structure is a mounting plate comprising a structure for mounting the plate to the rotary shaft so that the plate rotates with the shaft about a center of rotation, and an arcuate slot having an at least part circular curvature centered about the axis of rotation.

16. A door closer as claimed in claim 15 wherein the arcuate slot extends between the second latch member and the center of rotation.

17. A door closer as claimed in claim 16 wherein the arcuate slot is substantially symmetrical about a line extending from the center of rotation to the second latch member.

18. A door closer as claimed in claim 15 wherein the arcuate slot extends through an angle of at least 150 degrees.

19. A door closer as claimed in claim 15 wherein the arcuate slot extends through an angle of less than 190 degrees.

* * * * *